United States Patent [19]

Barbe et al.

[11] 4,150,081

[45] Apr. 17, 1979

[54] PROCESS FOR PRODUCING POLYESTER FIBERS HAVING WOOL-LIKE HAND

[75] Inventors: Gerard Barbe, Craponne; André Deyres, Venissieux, both of France

[73] Assignee: Rhone Poulenc Textile, Paris, France

[21] Appl. No.: 697,843

[22] Filed: Jun. 21, 1976

Related U.S. Application Data

[62] Division of Ser. No. 495,124, Aug. 5, 1974, Pat. No. 4,060,968.

[30] Foreign Application Priority Data

Aug. 3, 1973 [FR] France ..... 73 28756
Jun. 10, 1974 [FR] France ..... 74 20255

[51] Int. Cl.[2] ..... D01D 5/22
[52] U.S. Cl. ..... 264/168; 264/171; 264/210 F
[58] Field of Search ..... 264/171, 210 F, 168

[56] References Cited

U.S. PATENT DOCUMENTS

| | | | |
|---|---|---|---|
| 3,118,011 | 1/1964 | Breen | 264/171 |
| 3,418,200 | 12/1968 | Tanner | 264/171 |
| 3,570,235 | 3/1971 | Tukuhava et al. | 264/171 |
| 3,671,379 | 6/1972 | Evans et al. | 264/171 |

FOREIGN PATENT DOCUMENTS

| | | | |
|---|---|---|---|
| 43-28790 | 12/1968 | Japan | 264/171 |
| 44-2504 | 2/1969 | Japan | 264/171 |
| 44-7746 | 4/1969 | Japan | 264/171 |
| 1016861 | 1/1966 | United Kingdom | 264/171 |

*Primary Examiner*—Jay H. Woo
*Attorney, Agent, or Firm*—Murray & Whisenhunt

[57] ABSTRACT

Bicomponent polyester fibers exhibiting a hand similar to wool, a crimp contraction less than 60%, and a crimp frequency of at least 7 half-waves per centimeter, and the process for producing the same, are disclosed.

These crimped bicomponent fibers are useful in the textile field, particularly to at least partially replace the wool in polyester/wool blends.

8 Claims, No Drawings

PROCESS FOR PRODUCING POLYESTER FIBERS HAVING WOOL-LIKE HAND

This is a division of application Ser. No. 495,124 filed Aug. 5, 1974 now U.S. Pat. No. 4,060,968.

BACKGROUND OF THE INVENTION

The present invention relates to crimped bicomponent polyester fibers, formed of two different polyesters having different properties with respect to various mechanical and/or thermal treatments, especially treatments subsequent to shrinking or stretching operations. The fibers exhibit a hand similar to that of wool, and exhibit good processability in fiber systems.

Elastic crimped fibers of polymeric materials have been previously obtained by various mechanical processing methods, such as by assembling two filaments which are twisted in opposite direction (torsion twisting), and thereafter the twist is fixed and the filaments are untwisted, with the resulting filaments exhibiting a set crimp.

Bicomponent filaments have been obtained by extruding at least two different polymers, having different shrinking potentials, which may be of substantially the same or quite different nature, through the same spinneret die opening. These bicomponent fibers have a latent crimping ability which can be developed during subsequent processing steps. The results obtained by the prior art in the field of polyester filaments made of a single polymer, and crimped by conventional methods, such as the use of a heated sharp edge, of by false twisting, have never been satisfactory, as the crimp and the fiber elasticity disappear because of creep of the material. This problem is especially significant during those times when the filaments are subjected to tension in the manufacture of finished products, such as in the making of woven or knit fabrics, or in the process of manufacturing finished goods from such finished products. Polyester polymers are known to have significant plastic flow, so that the elasticity of the fibers, even when the fibers are composite fibers, rapidly decreases with fatigue.

The prior art has suggested that a crimped bicomponent fiber be made of a homopolyester and a copolyester made from diacids, at least one diacid being common to the two polymers, and a diol and one or more triols. For instance U.S. Pat. No. 3,454,460 discloses a composite polyester fiber made of polymethylene glycol terephthalate and a copolymer of polymethylene glycol terephthalate and of a terephthalate of another diol or of a polymethylene glycol isophthalate.

French Pat. No. 1,486,035 discloses a composite polyester filament made of polyethylene terephthalate and polyethylene terephthalate cross-linked with trimethylol propane.

French Pat. No. 1,442,768 discloses a composite fiber which is capable of developing a helical crimp and which is stable to heat and to deformation. Among components taught by this patent as suitable for making the composite fiber are polyethylene terephthalate and polybutylene terephthalate. The products of this patent have a slightly better crimp permanency than other prior bicomponent polyester fibers.

The prior art fibers described above, although they have elastic properties which are more permanent than those of textured fibers produced by conventional mechanical processes, are still not completely satisfactory for textile uses.

Copending, commonly assigned U.S. patent application, Ser. No. 456,476 discloses bicomponent polyester filaments wherein one filament component is polyethylene terephthalate and the other filament component is polybutylene terephthalate which has been sparingly cross-linked with trimethylol propane. These filaments exhibit improved permanency of crimping, compared to the other prior art acknowledged hereinabove.

SUMMARY OF THE INVENTION

The present invention relates to bicomponent polyester fibers exhibiting a hand which is similar to that of wool. The fibers have a crimp contraction less than 60%, preferably less than 40%, and a crimp frequency of at least 7 half waves per centimeter, preferably between 7 and 10 half waves per centimeter.

The fibers are produced by simultaneously extrudng side-by-side two different polymers through a spinneret orifice. One polymer is a polyethylene terephthalate having an intrinsic viscosity no greater than 0.60, and the other polymer is a sparingly cross-linked polybutylene terephthalate. The extruded bicomponent fiber is steam drawn at a temperature of 80 to 100° C., and then crimped at a temperature between 100 and 150° C.

DETAILED DESCRIPTION OF THE INVENTION

In producing bicomponent polyester fibers of the present invention, the polyethylene terephthalate component should have an intrinsic viscosity no greater than 0.60, and preferably between 0.45 and 0.60. The optimum polyethylene terephthalate intrinsic viscosity will vary according to the particular use applications for which the particular fibers are designed. Thus, for weaving applications, it is generally preferred that polyethylene terephthalate intrinsic viscosity be about 0.55, whereas for knitting applications it is preferred that the intrinsic viscosity be near 0.50.

If desired, the polyethylene terephthalate component may be sparingly cross-linked, by the addition of 0.20 to 0.70 mole percent of a cross-linking agent, based on the moles of terephthalate units.

The polybutylene terephthalate component of the fibers of the present invention is sparingly cross-linked by 0.20 to 0.60 mole percent of a cross-linking agent, based on the moles of terephthalate units.

The cross-linking of the polyethylene terephthalate and/or the polybutylene terephthalate is by use of polyfunctional cross-linking agents containing 3 or 4 ester-forming groups. Particularly preferred cross-linking agents are triols or tetrols, including polyphenols. The aliphatic triols or tetrols generally contain from 3 to 15 carbon atoms, preferably from 3 to 6 carbon atoms, whereas the polyphenols generally contain from 6 to 15 carbon atoms, preferably 6 carbon atoms. Suitable compounds include trimethylolpropane, trimethylolethane, pentaerythritol, glycerin and phloroglucinol and hydroxyhydroquinone.

Other classes of cross-linking agents include triacids or tetracids, generally of 5 to 20 carbon atoms, preferably containing 10 to 14 carbon atoms, and including acid anhydrides. Suitable acids include trimesic acid, trimellitic acid or anhydride and pyromellitic acid or anhydride.

Finally, amino acids and acid alcohols may be used as the cross-linking agents. Normally, these cross-linking agents wil contain one amino or hydroxy radical, although in some instances two such radicals will be present in the cross-linking agents, which may containg from 3 to 15, preferably 4 to 10, carbon atoms. Examples of suitable compounds include hydroxyisophthalic acid and aminoisophthalic acid.

It is generally preferred to use a polybutylene terephthalate which has a relatively low viscosity, for instance a viscosity in the molten state at 260° C. which is less than 4,000 poises, in order to obtain fibers exhibiting low crimp contraction and good processability as staple fibers.

The proportion of the polyester components in the fibers may vary over wide limits, but normally from 50 to 80% by weight of polyethylene terephthalate, and from 50 to 20% by weight of the sparingly cross-linked polybutylene terephthalate, will be used.

The polymers are spun simultaneously and side by side through the same spinneret orifice while in molten state, using conventional bicomponent spinning techniques. For instance, the process disclosed in the commonly assigned co-pending application Ser. No. 356,476, disclosure of which is hereby incorporated by reference, may be used.

Normally, the extrusion or spinning temperature will be between 260° C. and 295° C., but this will vary depending upon the proportions of the components, as well as the degree of cross-linking of one or both polymers.

The extruded bicomponent filaments are then subjected to a steam drawing, wherein the filaments are drawn in the presence of steam at a temperature between 80 and 100° C., and at a draw ratio of about 2 to about 4X, preferably between 2.6 and 3.3X. The drawing, which is preferably conducted after the extruded filaments are gathered in a coarse count tow, is advantageously conducted in a hopper fitted with a steam inlet. Any conventional steam drawing apparatus may be used, for instance, the apparatus disclosed in the French Pat. No. 1,123,512 is suitable.

The drawn bicomponent filaments are then subjected to a crimp development treatment at a temperature between 100 and 150° C. When the filaments are in the form of a tow, the tow may be subjected before crimp to a whirling air flow, for instance, by passing through a nozzle in concurrent or countercurrent flow to an airstream, so that the tow is opened, with the filaments separated from each other, thereby making a uniform crimp development of all of the two filaments easier.

The crimp development may be conducted in hot air or dry steam or other suitable atomsphere, but is preferably conducted in a mixture of hot air and steam, suitably at a pressure of 3 to 6 bars. The crimp development step may be deferred and conducted during a subsequent finishing operation, such as during the dyeing operation, or even, if required, after weaving or knitting. Preferably, however, the crimp development is conducted directly after the drawing step, with both operations being conducted on a continuous basis, which results in a more regular crimp being imparted to the fiber.

The resulting filaments, which may be in tow form, exhibit a very fine crimp, a crimp contraction no greater than 60%, generally less than 40%, and a high crimp frequency of at least 7 half-waves per centimeter, preferably between 7 and 10 half-waves per centimeter. Normally the magnitude of the crimps — that is, the maximum average distance that the axis of the crimped filament will be displaced in the crimp from the major axis of the filament (e.g. the average centerline of the filament) — will vary from about 0.01 mm to about 1 mm, preferably 0.02 to 0.10 mm.

The crimped bicomponent filaments may be cut, converted, or stretch-broken without difficulty by known means to produce staple fibers. These staple fibers have a very fine crimp and exhibit medium elasticity, and can be easily processed, either in the pure or in the blended state, on conventional needle or roller equipment. Likewise, card slivers obtained from the fibers of the present invention may be easily processed into spun yarns. This easy processing ability of the fibers of the present invention for being processed on carding or spinning equipment, as well as needle or roller equipment, is what is meant when the present fibers are described as exhibiting good processability as staple fibers (the staple fibers can be of a short or long staple fiber system).

This staple fiber good processability of the fibers of the present invention is quite surprising, since staple fibers obtained by cutting, converting, or stretch-breaking the bicomponent filament yarns of the working examples of the copending U.S. patent application Ser. No. 356,476 do not possess such good processability. As a matter of fact, the strong helical crimp of the fibers of this copending application act as a spring, so that the carding of the fibers, either pure or even blended with natural fibers, is impossible.

As the composition of the fibers of the present invention and the fibers obtained from the working examples of the aforesaid copending application is very similar, the significant difference in the processability of the fibers is quite surprising. The production of fibers exhibiting good processability when used unblended in a long or short staple fiber system is possible with the selection of the particular polymers, and in predetermining the viscosities of the polymers, combined with particular conditions or crimp development and, above all, particular conditions for drawing. The fibers of the present invention are much easier to process by carding, and, in addition, exhibit less defects on converting, as well as a better abrasion resistance.

Furthermore, the fibers produced according to the present invention have a soft hand which is similar to that of wool, which enables wool to be at least partly replaced by the fibers of the present invention in many uses.

Most of the fabrics of polyester/wool blends contain about 55% by weight of polyester and about 45% by weight of wool, in order to have the resulting fabric exhibit the easy care characteristics of the synthetic fibers while maintaining a suitable hand, although different from that of a pure wool fabric.

With the fibers of the present invention, it is now possible to reduce the wool content, and to increase the polyester content, of blends without unduly effecting the hand of the resulting fabric, which is of significant economical interest in view of the current high wool prices, which are continually increasing. For instance, very good quality fabrics or worsted cloth can be made by mixing 70 to 80% by weight of the fibers of the present invention and 20 to 30% by weight of wool. Furthermore, the hand of fabrics made of the fibers at the present invention is such that not only can the wool content of fabrics be reduced, but in addition, coarser wools may be used without prejudice to the hand of the resulting finished article, which is another economical improvement otainable with the present invention.

For instance, fabrics made from blends of 70% by weight of fibers of the present invention and 30% by weight of wool fibers, 25 μ in diameter exhibit a hand which is identical to fabrics made from blends of 55% by weight of standard polyester fibers and 45% by weight of wool fibers 21 μ in diameter.

Furthermore, fabrics made from the fibers of the present invention, either in the pure form or in blends with a low wool content, exhibit a slight elasticity of both warp and weft, which allows the comfort of garments made from such fabrics to be improved without risk of too great a deformation to wear. In addition, this elasticity facilitates the various steps involved in making such garments, such as sewing, fit, seam cleanliness, etc.

The fibers of the present invention find their application mainly in very good quality fabrics or worsted cloth, but may be also used in knitting applications, especially when used in the pure state in so-called "hand knitting yarn" uses.

EXAMPLES OF THE INVENTION

In the following examples, parts and percentages are given in weight units.

In these examples, and the rest of this specification, the "intrinsic viscosity" is measured from a solution at 25° C. which contains 1% by weight per volume of polymer in orthochlorophenol.

The "viscosity index" is determined from the viscosity in solution measured on the solution itself according to the formula:

$$IV = \frac{\text{intrinsic viscosity}}{\text{concentration}} \times 1000$$

wherein concentration is expressed in units of g/l.

The "crimp contraction" is determined by the formula:

$$\frac{L - 1}{L} \times 100$$

wherein L is the uncrimped yarn length measured under a tension of 250 mg/dtex, and 1 is the crimped yarn length measured in the absence of tension.

The "half-uncrimping force" is determined from the stress-strain diagram obtained from an Instron tensile tester for the interval 1 L and is read as the abscissa value corresponding to E%/2 on the ordinate.

The "ease of forming" is measured as follows:

Samples are cut out of a fabric warpwise and weftwise, and then two marks are made a distance $L_o$ from each other. A weight of 2150 grams is hung on each sample, and the samples are subjected to a steam treatment at 95 - 98° C. under this load for one minute, then the samples are dried in dry air at 150° C. for three minutes under a load of only 150 grams. The length $L_l$ is measured between the two marks and the ease for forming warpwise and weftwise is calculated from the formula:

$$\frac{L_1 - L_o}{L_o} \times 100.$$

The "flex abrasion index" is measured on fibers which have been stabilized by being treated for 30 minutes in dry air at 150° C. The measurement is carried out at 22 ± 2° C. and at 65% R.H. on individual filaments tensioned under an angle of 110° on a steel wire 20 μ in diameter, with a set tension of 0.100 g/dtex. The filaments so arranged are moved to and fro, rubbing on the steel wire until they are broken. The number of cycles is measured up to the breaking point, and the flex abrasion index value is calculated as the average value of 25 such measurements.

EXAMPLE 1

This example relates to the side by side spinning of a bicomponent polyester filament of a polyethylene terephthalate having an intrinsic viscosity of 0.60 and a polybutylene terephthalate sparing cross-linked by 0.3 mole % of trimethylol propane, based on the moles of terephthalate units, having a viscosity index of 1,080 and a viscosity in the molten state at 260° C. of 4,000 poises.

The polymers are separately melted, the polyethylene terephthalate at 290° C. and the polybutylene terephthalate at 255° C., passed through a heated transfer vessel at 280° C. and then are extruded, in proportions of 70% of polyethylene terephthalate and 30% of polybutylene terephthalate, through a spinneret head having 56 orifices, each 0.34 mm in diameter. The spinning speed was 1200 m/min, and yarns of 672 dtex/56 fil., are obtained.

630 Of these yarns are gathered into a tow which is drawn at a draw ratio of 3.03 X at a speed of 60 m/min by passing through a hopper containing an 80° C. steam atomsphere. The drawing apparatus is illustrated in French Pat. No. 1,123,512.

The drawn tow was then passed through a nozzle in which it is opened then, in contact with a mixture of air and dry steam at 125° C., to develop crimp.

The #140,000 dtex tow obtained has the following characteristics, measured on individual filaments:

| | |
|---|---|
| Filament count | 4.26 dtex |
| Filament elongation | 52.2% |
| Breaking strength | 31.4 g/tex |
| Modulus of elasticity | 402 g/tex |
| Crimp contraction | 41.4% |
| Number of half-waves/cm | 9.5 |
| Half-uncrimping force | 21.2 mg/tex |

This tow is converted into a top, the fibers of which are 88 mm long. The top was satisfactorily passed through needle equipment to form a top silver, which exhibited a very good appearance and a hand similar to wool.

EXAMPLE 2

Example 1 was repeated, but using proportions of 50/50 by weight of the two polymers. The spinning and drawing conditions were otherwise the same, but the crimp development was conducted at a temperature of 105° C.

A 138,000 dtex tow was obtained, which exhibited the following characteristics, measured on individual filaments:

| | |
|---|---|
| Filament count | 4.47 dtex |
| Breaking elongation | 53.1% |
| Breaking strength | 31.5 g/tex |
| Modulus of elasticity | 318 g/tex |
| Crimp contraction | 55.2% |
| Number of half-waves/cm | 11.5 |
| Half-uncrimping force | 22 mg/tex |

A portion of this tow was converted to a top, the fibers of which were about 90 mm long. The top was dyed and then mixed with wool fibers 25 μ in diameter, which had been dyed separately, in the proportion of 70% by component fibers and 30% wool fibers. The blended fibers were then processed into a 40 Nm, two-ply spun yarn with 480 turns per meter. A "Prince de Galles" fabric was made from the spun yarn, and fabric weighed 304 g/m$^2$, with 28 yarns/cm warpwise and 26 yarns/cm weftwise texture. The fabric was desized, slightly rope fulled and thermally treated on a stenter at a temperature of 180° C.

The appearance of the resulting fabric was very close to that of a pure wool fabric, and exhibited the following characteristics:

| | Warp | Weft |
|---|---|---|
| Dimensional stability | − 1.0% | + 0.1% |
| Press stability at 150° C | − 1.0% | − 0.9% |
| Extensibility under 0.300 kg/cm width | + 4.5% | + 8.5% |
| Extensibility under 1 kg/cm width | + 7.0% | + 12.2% |
| Immediate residual elongation | + 0.5% | + 2.0% |
| Wash and wear | 4/3 | |
| Ease of forming | 3.2% | 6.5% |

Another portion of the 138,000 dtex tow was cut into fibers 60 mm long and was spun in the unblended or pure state on a conventional cotton system without any difficulty to produce a Nm 26/2 yarn with Z primary twist of 400 turns and 8 ply twist of 320 turns.

EXAMPLE 3

Example 1 was repeated, with the same polymers in the same proportions spun, but through a spinneret head pierced with 132 orifices, each 0.34 mm in diameter. 290 yarns, each with a total count of 1584 dtex/132 filaments, were gathered into a tow, drawn, and crimp developed under the same conditions as in Example 1.

The 154,000 dtex tow obtained exhibited the following characteristics, measured on individual filaments:

| | |
|---|---|
| Filament count | 4.08 dtex |
| Breaking elongation | 41.8% |
| Breaking strength | 32.5 g/tex |
| Modulus of elasticity | 473 g/tex |
| Crimp contraction | 52.3% |
| Number of half-waves/cm | 10.9 |
| Half-uncrimping force | 32.5 mg/tex |

The drawn, crimped tow was stretch-broken and directly spun.

A 6000 dtex tow was processed into a 500 dtex yarn, having twist of 550 turns, and a 12000 dtex tow was processed into a 1000 dtex yarn having a twist of 390 turns. The sectional diagram of these yarns was similar to that of wool, and the yarns had an average fiber length of 70 mm.

Knitted articles were made from these yarns, and the knitted articles had a very soft hand which was very similar to wool.

EXAMPLE 4

Example 2 was repeated, spinning the same polymers in the same proportions (50/50) through the same spinneret (56 orifices each 0.34 mm in diameter).

150 Yarns were gathered to form a tow, which was drawn at a draw ratio of 3 X in steam at 75° C on the draw apparatus of Example 2, and then the drawn tow was subjected to the same crimp development as Example 2 (at 105° C.). The resulting drawn crimped tow exhibited the following characteristics measured on individual filaments:

| | |
|---|---|
| Total count | about 36 000 dtex |
| Filament count | 4.76 dtex |
| Breaking elongation | 48.8% |
| Breaking strength | 27.9 g/tex |
| Modulus of elasticity | 347 g/tex |
| Crimp contraction | 19.4% |
| Number of half-waves/cm | 6.7 |
| Half-uncrimping force | 23.3 mg/tex |

The tow was cut into fibers 60 mm long, which were spun on a conventional cotton system without any difficulty to form Nm 20 (500 dtex) yarns, having a twist of 430 turns.

Single knitted fabric made from these yarns on circular knitting machines expected very good, soft, wool-like hand, after de-oiling and steam treatment at 105° C. for 5 minutes.

EXAMPLES 5 - 8

These examples relate to a side-by-side extrusion of a polyethylene terephthalate polymer, cross-linked by 0.65 mole % of trimethylolpropane, based on the moles of terephthalate units, having an intrinsic viscosity of 0.55, and of different polybutylene terephthalate polymers, each cross-linked by 0.3 mole % of trimethylolpropane based on the moles of terephthalate units. The viscosities of the polybutylene terephthalate polymers, in the molten state at 260° C., were as follows:

Example 5 = 4 800 poises
Example 6 = 4 590 poises
Example 7 = 3 200 poises
Example 8 = 3 050 poises The two polymers were extruded side-by-side at a temperature of 270° C. through a spinneret head containing 132 orifices, each 0.34 mm in diameter, at a yarn take-up speed of 1000 m/min.

400 of the resulting yarns were gathered into a tow, which was drawn at a draw ratio of 3.03 X at a speed of 60 m/min. by passage through a hopper containing a steam atomsphere at 86° C. The draw equipment was otherwise similar to that of Example 1. The drawn tow was then passed through a nozzle wherein it was opened by compressed air and then passed through a crimp development chamber containing steam at 125° C. and finally the drawn crimped tow fell down vertically 1.20 m into a receiver.

The different tows which were obtained exhibited the following characteristics:

| | Ex.5 | Ex.6 | Ex.7 | Ex.8 |
|---|---|---|---|---|
| filament count in dtex | 3.56 | 6.10 | 3.24 | 3.51 |
| elongation (%) | 55.9 | 46.3 | 50.8 | 43.7 |
| tenacity in g/tex | 23.9 | 27.3 | 23.5 | 21.3 |
| crimp contraction (%) | 34.3 | 56.2 | 27.5 | 15.9 |
| half uncrimping force in mg/tex | 34.4 | 39.7 | 12.5 | 25.7 |
| number of half waves/cm | 10.9 | 15.5 | 8 | 9.6 |
| total number of defects in the Pacific Converter/tow kg | 1 182 | 1 872 | 1 641 | 529 |
| for instance : neps | 478 | 458 | 315 | 106 |
| slubs | 477 | 1 155 | 932 | 264 |
| fibre bundles and others | 227 | 259 | 394 | 159 |
| flex-abrasion index | 5 015 | 4 919 | 3 006 | 2 800 |

What is claimed is:

1. A process for producing crimped bicomponent polyester fibers, said process comprising (a) simultaneously extruding side-by-side through a spinneret orifice
  (i) a polyethylene terephthalate having an intrinsic viscosity no greater than 0.60, and
  (ii) a sparingly-cross-linked polybutylene terephthalate
  (iii) in proportions of about 50 to about 80% by weight of the fiber of polyethylene terephthalate and about 50 to about 20% by weight of the fiber of polybutylene terephthalate, to form a bicomponent fiber;
(b) thereafter steam drawing the bicomponent fiber by a draw ratio of about 2X to about 4X and at a temperature of about 80 to about 100° C. to form a drawn bicomponent fiber; and
(c) thereafter crimp developing the drawn bicomponent fiber at a temperature of about 100 to about 150° C. to form at least 7 crimp half waves per cm of fiber length.

2. A process of claim 1, wherein the drawn bicomponent fibers are crimped to form from 7 to about 10 crimp half-waves/cm.

3. A process of claim 2, wherein the polyethylene terephthalate polymer contains from 0 to 0.70 mole % of a trifunctional or tetrafunctional cross-linking agent, based on the moles of terephthalate units.

4. A process of claim 3 wherein the polyethylene terephthalate contains at least 0.20 mole % of said cross-linking agent.

5. A process of claim 1, wherein the polyethylene terephthalate component has an intrinsic viscosity of 0.45 to 0.60.

6. A process of claim 1, wherein the polybutylene terephthalate polymer is sparingly cross-linked by 0.20 to 0.60 mole %, based on moles of terephthalate units, of a trifunctional or tetrafunctional ester-forming cross-linking agent.

7. A process of claim 6, wherein the sparingly cross-linked polybutylene terephthalate polymer has a viscosity in the molten state at 260° C. no greater than 4,000 poises.

8. A process of claim 1 wherein said bicomponent filaments are extruded at a temperature of 260 to 295° C.

* * * * *